US006222318B1

(12) United States Patent
Oomen et al.

(10) Patent No.: US 6,222,318 B1
(45) Date of Patent: Apr. 24, 2001

(54) LOW-PRESSURE MERCURY VAPOR DISCHARGE LAMP

(75) Inventors: Emmanuel W. J. L. Oomen, Morgantown; Adrianus J. H. P. Van Der Pol; Leonie M. Geerdinck, both of Eindhoven, all of (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/246,333

(22) Filed: Feb. 9, 1999

(30) Foreign Application Priority Data

Mar. 9, 1998 (EP) ..... 98200747

(51) Int. Cl.[7] ..... H01J 17/02
(52) U.S. Cl. ..... 313/613; 313/243
(58) Field of Search ..... 313/613, 239–243, 313/313, 622, 614, 242

(56) References Cited

U.S. PATENT DOCUMENTS 4,308,650 1/1982 Hernandez et al. ..... 29/25.13
4,544,997 10/1985 Seuter et al. ..... 362/263
5,272,407 * 12/1993 Tillman et al. ..... 313/25
5,646,487 * 7/1997 Ikedo et al. ..... 315/94
5,686,795 * 11/1997 Sakoske et al. ..... 313/613
5,702,179 * 12/1997 Sidwell et al. ..... 362/255

* cited by examiner

*Primary Examiner*—Frank G. Font
*Assistant Examiner*—Layla Lauchman
(74) *Attorney, Agent, or Firm*—Brice Faller

(57) ABSTRACT

Low-pressure mercury vapour discharge lamp is provided with a discharge vessel (10) and a first and a second end portion (12*a*; 12*b*). The discharge vessel (10) encloses a discharge space (13) provided with a filling of mercury and a rare gas in a gastight manner. Each end portion (12*a*; 12*b*) supports an electrode (20*a*; 20*b*) which is arranged in the discharge space (13). Current supply conductors (30*a*, 30*a'*; 30*b*, 30*b'*) *extend from the electrodes (*20*a*; 20*b*) through the end portions (12*a*; 12*b*) to outside the discharge vessel (10). A UV-reflecting shield (15*a*; 15*b*) is positioned in the space between the electrodes (20*a*; 20*b*) and the end portions (12*a*; 12*b*), *thereby protecting the end portions (*12*a*; 12*b*) from the creation of reactive sites in the end portions (12*a*; 12*b*) at which reactive sites mercury is bound. Preferably, the shield (15*a*; 15*b*) is attached to the current supply conductors (30*a*, 30*a'*; 30*b*, 30*b'*). The lamp according to the invention has a comparatively low mercury consumption.

8 Claims, 2 Drawing Sheets

LOW-PRESSURE MERCURY VAPOR DISCHARGE LAMP

BACKGROUND OF THE INVENTION

The invention relates to a low-pressure mercury vapor discharge lamp provided with a discharge vessel which encloses a discharge space provided with a filling of mercury and a rare gas in a gastight manner, the low-pressure mercury vapor discharge lamp comprises discharge means for generating and maintaining a discharge in the discharge space, the discharge vessel being translucent to radiation generated in the discharge space and said discharge vessel having a first and a second end portion.

A low-pressure mercury vapor discharge lamp of the kind mentioned in the opening paragraph is known from U.S. Pat. No. 4,544,997. The inner surface of the tubular wall of the discharge vessel of the known lamp is provided with a translucent layer of a metal oxide. The metal oxide layer serves to counteract that the wall of the discharge vessel is attacked owing to interactions with mercury and thus has a favorable influence on the maintenance of the radiation output of the lamp.

The mercury consumption of the lamp, i.e. the quantity of mercury bound to lamp components during lamp operation and thus no longer available for the operation of the lamp, is comparatively low owing to the metal oxide layer as compared with that in lamps which lack such a metal oxide layer. Nevertheless, a comparatively large mercury dose is necessary also for the known lamp if a sufficiently long lamp life is to be realized. This forms an environmental hazard in the case of inexpert waste disposal after the end of lamp life.

SUMMARY OF THE INVENTION

To achieve this object, the low-pressure mercury vapor discharge lamp to reduce mercury consumption, shielding means are present in the discharge vessel for counteracting that UV radiation generated in the discharge space will reach the end portions of the discharge vessel.

Mercury forms the primary component for the efficient generation of ultraviolet (UV) light in mercury vapor discharge lamps. A luminescent layer comprising a luminescent material (for example a fluorescent powder) may be present on the inner surface of a wall of the discharge vessel for the purpose of converting UV into other wavelengths, for example into UV-B and UV-A for suntanning purposes (sun couch lamps), or into visible radiation. Such discharge lamps are accordingly also called fluorescent lamps. It is observed that mercury is absorbed in the glass during the operation of low-pressure mercury vapor discharge lamps. It is found in general that mercury is chemically bound to the glass, with the result that the quantity of mercury available for the discharge decreases, which adversely affects lamp life. Further experiments have shown that the mercury enters into a complicated (chemical) bond with the glass surface. To counteract such a mercury loss during lamp life, a comparatively high mercury dose is necessary in the lamp, which is undesirable from an environmental point of view. The inventors have gained the insight that UV radiation (originating from the discharge) creates reactive spots at the surface of the end portions. Mercury is bound to such reactive spots. In contrast to the inner wall of the discharge vessel, where the luminescent layer present considerably reduces the sensitivity to attacks by UV radiation, the surfaces of the end portions are not protected against the influence of UV radiation. A luminescent layer is absent in some discharge lamps; for example, a $Y_2O_3$ layer may be used in such lamps. The application of shielding means in the discharge vessel prevents at least substantially that the UV radiation generated by the discharge reaching the end portions of the discharge vessel. The mercury consumption of the discharge lamp is limited by a considerable reduction in the degree to which UV radiation reaches the end portions.

A preferred embodiment of the low-pressure mercury vapor discharge lamp according to the invention is characterized in that the shielding means reflect UV radiation. Reflection of the ultraviolet (UV) radiation prevents this radiation from being lost (for example through absorption) and improves the luminous efficacy of the lamp. An alternative possibility for preventing UV radiation from reaching the end portions is by guiding away of the undesirable radiation, for example through the use of light waveguides.

If as little as possible UV radiation useful for the generation of visible light is to be lost in the discharge space, it is desirable for the shielding means to be situated not in the region between the discharge in the discharge vessel and the luminescent layer, but at a side of the respective electrode (discharge means) facing away from the discharge space. Accordingly, a preferred embodiment of the low-pressure mercury vapor discharge lamp according to the invention is characterized in that the discharge means comprise a first electrode arranged in the discharge space and supported by the first end portion and a second electrode arranged in the discharge space and supported by the second end portion, and in that the shielding means are present between the first electrode and the first end portion and/or between the second electrode and the second end portion.

A further embodiment of the low-pressure mercury vapor discharge lamp according to the invention is characterized in that the shielding means comprise a screen which is provided with a UV-repelling coating or layer at least at a surface which faces the discharge space. The screen acts as a shield against the UV radiation. The shape of the screen is preferably adapted to the shape of the discharge vessel.

A particularly preferred embodiment of the low-pressure mercury discharge lamp according to the invention is characterized in that the discharge means comprise a first electrode arranged in the discharge space and supported by the first end portion and a second electrode arranged in the discharge space and supported by the second end portion, in that current supply conductors extend from the respective electrodes through the end portions to outside the discharge vessel, and in that each screen is fastened to the corresponding current supply conductor. Screens fastened to the current conductors can be incorporated in the existing lamp in a simple manner without further adaptations. Said screens are preferably electrically insulating.

The screen itself must not absorb mercury. A further embodiment of the low-pressure mercury vapor discharge lamp according to the invention is characterized in that the material of the layer on the screen comprises at least an oxide of at least one element from the series formed by magnesium, aluminum, titanium, zirconium, yttrium, and the rare earths.

BRIEF DESCRIPTION OF THE DRAWINGS

The Figures are purely diagrammatic and not drawn true to scale. Some dimensions are particularly exaggerated for the sake of clarity. Similar components have been given the same reference numerals in the Figures as much as possible.

DETAILED DESCRIPTION OF THE PREFERRED EMBODIMENTS

Figure 1A:
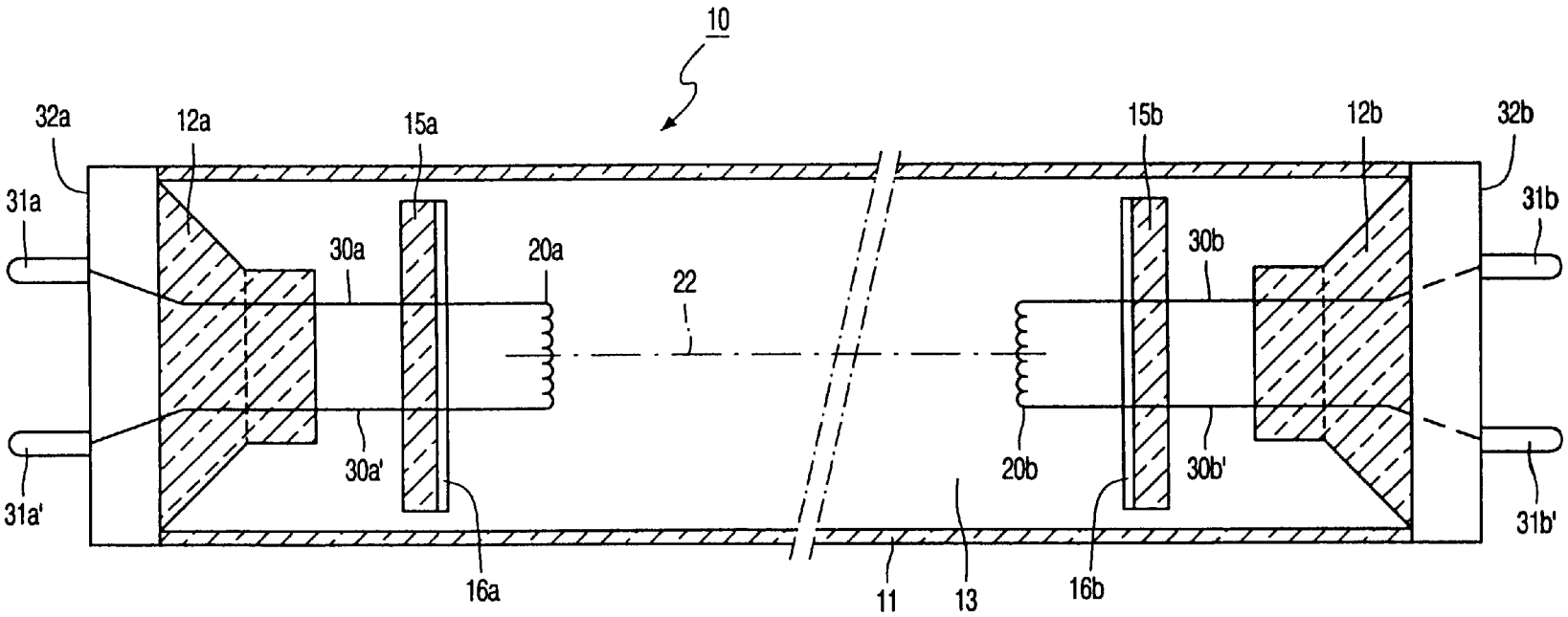
FIG. 1A is a longitudinal sectional view of a low-pressure mercury vapor discharge lamp according to the invention.
Figure 1B:
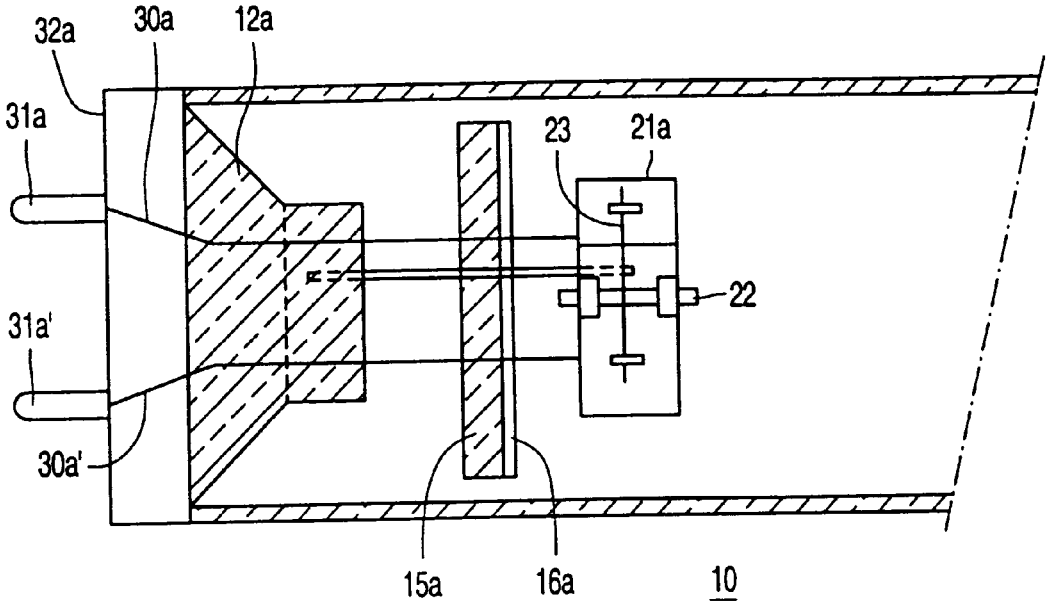
FIG. 1B shows a detail from FIG. 1A.

FIG. 1A shows a low-pressure mercury vapor discharge lamp provided with a glass discharge vessel 10 with a tubular portion 11 which is translucent to radiation generated in the discharge vessel 10 and with a first and a second end portion 12*a*; 12*b*. In this example, the tubular portion 11 has a length of 120 cm and cm. The discharge vessel 10 encloses a discharge space 13 in a gastight manner, which space is provided with a filling of 1 mg mercury and a rare gas, for example argon. The wall of the tubular portion is coated with a luminescent layer comprising a luminescent material (for example a fluorescent powder) which converts the ultraviolet (UV) radiation generated through ionization of the mercury, usually into visible light. The end portions 12*a*; 12*b* each support an electrode 20*a*; 20*b* which is arranged in the discharge space 13. Current supply conductors 30*a*, 30*a*'; 30*b*, 30*b*' extend from the electrodes 20*a*; 20*b* through the end portions 12*a*; 12*b* to outside the discharge vessel 10. The current supply conductors 30*a*, 30*a*'; 30*b*, 30*b*' are connected to respective contact pins 31*a*, 31*a*' 31*b*, 31*b*', which are fastened to a lamp cap 32*a*; 32*b*. An electrode ring is arranged around each electrode 20*a*; 20*b*. FIG. 1B shows such an electrode ring 21*a* surrounding the electrode 20*a* (the electrode 20*a* is not shown in FIG. 1B). A glass capsule 22, with which mercury was dosed, is clamped on the electrode ring 21*a*. A metal wire 23 tensioned over the glass capsule 22 was for this purpose inductively heated in a high-frequency electromagnetic field, such that the capsule 22 was cut through and the mercury to be dosed was released from the capsule 22 into the discharge space 13.

Shielding means, in the example of FIGS. 1A and 1B in the form of a screen 15*a*; 15*b*, whose shape is adapted to that of the tubular portion 11, are present between the electrode 20*a*; 20*b* and the relevant end portion 12*a*; 12*b*. The screen 15*a*; 15*b* is so shaped that the screen 15*a*; 15*b* will cause substantially no scratches in the luminescent layer (not shown in FIG. 1A) provided on the inner surface of the discharge vessel 10 when the end portions 12*a*; 12*b* are being inserted into the tubular portion. The screen 15*a*; 15*b* is provided with a layer 16*a*; 16*b* on a surface which faces the discharge space, the material of these layers 16*a*, 16*b* includes at least an oxide of at least one element from the series formed by magnesium, aluminum, titanium, zirconium, yttrium, and the rare earths.

Figure 1C:
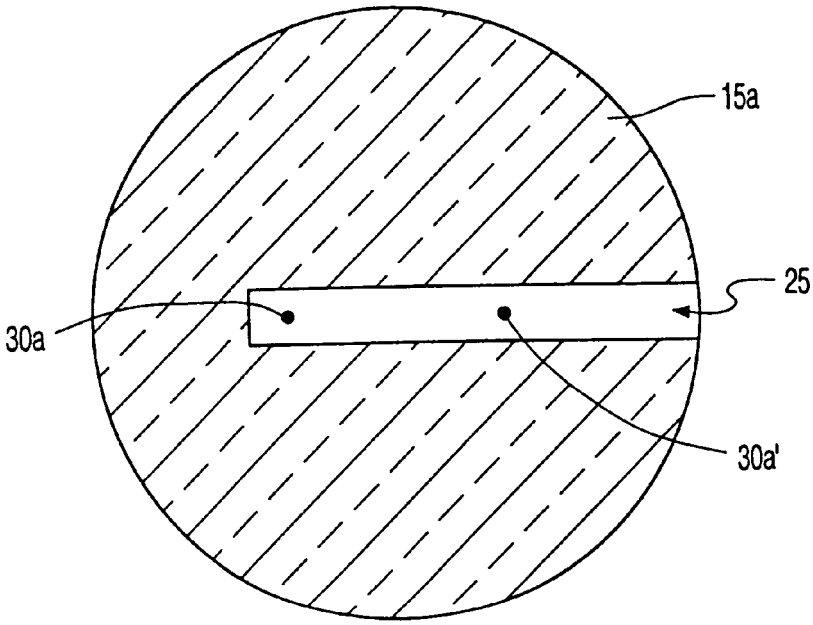
FIG. 1C shows an embodiment of the screen according to the invention.

The screen 15*a*; 15*b*, which may or may not be provided with a coating layer 16*a*; 16*b*, acts as a UV-radiation-repelling shield which substantially prevents UV radiation from reaching the end portions 12*a*; 12*b*. The shape of the screen 15*a*; 15*b* is preferably adapted so as to fit the shape of the discharge vessel 10. For example, if the discharge vessel 10 comprises a tubular portion 11 with a longitudinal axis 22 at the areas of the end portions, the screen 15*a*; 15*b* is a preferably situated in a plane transverse to the longitudinal axis 22 of the tubular portion 11 for obtaining an optimum shielding effect. If the discharge vessel 10 comprises a tubular portion 11 at the areas of the end portions 12*a*; 12*b*, the screen 15*a*; 15*b* is preferably at least substantially circular in shape and has a diameter which is smaller than or almost as large as the inner diameter of the tubular portion 11 of the discharge vessel 10. The screen 15*a*; 15*b* need not be flat, but may have, for example, bent or flared edges which facilitate mounting of the screens 15*a*; 15*b* in the discharge vessel 10. It is also possible for openings to be provided in the screen 15*a*; 15*b*. FIG. 1C shows an embodiment of the screen 15*a*; 15*b* according to the invention where a slot 25 is provided in the round glass plate 15*a* for allowing the current supply conductors 30*a*, 30*a*'; 30*b*, 30*b*' to pass. The shape of the screen 15*a*; 15*b* is adapted so as to fit the shape of the discharge vessel 10. The layer 16a; 16*b* is not shown in FIG. 1C.

For comparison, a lamp not according to the invention was manufactured, which lamp does not have the screens 15*a*; 15*b* between the electrodes 20*a*; 20*b* and the end portions 12*a*; 12*b*, but which corresponds to the lamp according to the invention in all other respects.

The lamps were subjected to an endurance test of 5000 hours. After the endurance test, the quantity of mercury bound to the end portions was ascertained by means of a wet-chemical analysis. The results (in $\mu$g) are shown in Table 1 for the lamp according to the invention (I) and the lamp not according to the invention (II).

TABLE 1

| quantity of bound mercury in $\mu$g in lamp according to the invention I and lamp not according to the invention II | |
|---|---|
| I | II |
| 10 | 57 |

The measure according to the invention leads to a strong reduction in the quantity of mercury bound to the end portions 12*a*; 12*b*. It was found that the amount of mercury consumed during the first burning hours of the lamp is substantially independent of the presence of the shielding means. Apparently it takes some time before UV radiation originating from the discharge has attacked the surface of the end portions 12*a*; 12*b* to such an extent that an increased binding of mercury will take place, whereupon the mercury is bound (chemically) to the surface of the glass of the end portions 12*a*; 12*b*. A considerable reduction in the mercury consumption was found for low-pressure mercury vapor discharge lamps fitted with screens 15*a*; 15*b* between the electrodes 20*a*; 20*b* and the respective end portions 12*a*; 12*b*, which screens are made from glass (for example pyrex glass) or mica fitted with a coating layer 16*a*; 16*b* of aluminum oxide and/or yttrium oxide.

It will be obvious that many variations are possible to those skilled in the art within the scope of the invention. The shape of the discharge vessel need not necessarily be elongate and tubular, but may differ therefrom. In particular, the discharge vessel may have a bent or meandering shape. The shape of the shielding means is adapted soas to fit the shape of the discharge vessel at the areas of the end portions. The discharge means may alternatively be situated outside the discharge vessel, for example in the case of a discharge lamp which is operated inductively. In that case, again, the shielding means must be positioned between the UV radiation generated by the discharge means and the end portions. Preferably, the shielding means are situated as close as possible to the end portions.

What is claimed is:

1. A low-pressure mercury vapor discharge lamp provided with a discharge vessel (10) which is provided with a filling of mercury and a rare gas and encloses said filling in a gastight manner, said low-pressure mercury vapor discharge lamp comprising discharge means (20*a*; 20*b*) for generating and maintaining a discharge in a discharge space within said vessel, said discharge generating UV radiation in the discharge space (13), said discharge vessel (10) being translucent to radiation generated in the discharge space (13) and said discharge vessel (10) having a first end portion (12*a*) and a second end portion (12*b*), and said low-pressure mercury vapor discharge lamp further comprising shielding means (15*a*; 15*b*) in the discharge vessel (10) for at least substantially preventing the UV radiation from reaching the end portions (12*a*; 12*b*) of the discharge vessel (10).

2. A low-pressure mercury vapor discharge lamp as claimed in claim 1, characterized in that the shielding means (15*a*; 15*b*) reflect UV radiation.

3. A low-pressure mercury vapor discharge lamp as claimed in claim 1, wherein the discharge means comprise a first electrode (20*a*) arranged in the discharge space (13) and supported by the first end portion (12*a*) and a second electrode (20*b*) arranged in the discharge space (13) and supported by the second end portion (12*b*), and wherein the shielding means (15*a*; 15*b*) are present between the first electrode (20*a*) and the first end portion (12*a*) and between the second electrode (20*b*) and the second end portion (12*b*).

4. A low-pressure mercury vapor discharge lamp as claimed in claim 1 wherein the shielding means comprise a pair of screens (15*a*; 15*b*), each said screen having a surface which faces the discharge space (131), and a UV-reoelling layer on each said surface.

5. A low-pressure mercury vapor discharge lamp as claimed in claim 4, characterized in that the discharge means comprise a first electrode (20*a*) arranged in the discharge space (13) and supported by the first end portion (12*a*) and a second electrode (20*b*) arranged in the discharge space (13) and supported by the second end portion (12*b*), in that current supply conductors (30*a*, 30*a*'; 30*b*, 30*b*') extend from the respective electrodes (20*a*; 20*b*) through the end portions (12*a*; 12*b*) to outside the discharge vessel (10), and in that each screen (15*a*; 15*b*) is fastened to the corresponding current supply conductor (30*a*, 30*a*'; 30*b*, 30*b*').

6. A low-pressure mercury vapor discharge lamp as claimed in claim 4, characterized in that the screen (15*a*; 15*b*) is electrically insulating.

7. A low-pressure mercury vapor discharge lamp as claimed in claim 4, characterized in that the layer (16*a*; 16*b*) on the screen (15*a*; 15*b*) comprises at least an oxide of at least one element from the group consisting of magnesium, aluminum, titanium, zirconium, yttrium, and the rare earths.

8. A low-pressure mercury vapor discharge lamp as claimed in claim 4, wherein the screen (15*a*; 15*b*) comprises glass or mica provided with a coating layer (16*a*; 16*b*) of at least one of aluminum oxide and yttrium oxide.

* * * * *